United States Patent [19]

Frund et al.

[11] 4,429,553

[45] Feb. 7, 1984

[54] CAM-SUPPORT CARRIAGE FOR A KNITTING MACHINE

[75] Inventors: Louis Frund, Monthey; Rémy Bruggmann, Fontanivent, both of Switzerland

[73] Assignee: Atelier de Construction Steiger S.A., Vionnaz, Switzerland

[21] Appl. No.: 266,212

[22] Filed: May 22, 1981

[30] Foreign Application Priority Data

Jun. 13, 1980 [CH] Switzerland ..... 4558/80

[51] Int. Cl.[3] ..... D04B 7/00

[52] U.S. Cl. ..... 66/78; 66/75.2

[58] Field of Search ..... 66/78, 57, 219, 218, 66/232, 75.2

[56] References Cited

U.S. PATENT DOCUMENTS

| | | | |
|---|---|---|---|
| 3,232,079 | 2/1966 | Levine et al. | 66/232 |
| 3,805,558 | 4/1974 | Protti | 66/75.2 |
| 3,815,065 | 6/1974 | Hadam | 66/75.2 X |
| 3,955,384 | 5/1976 | Hasegawa | 66/219 |
| 3,987,646 | 10/1976 | Knourek et al. | 66/232 |
| 4,138,865 | 2/1979 | Lüth | 66/219 |
| 4,281,523 | 8/1981 | Schimko | 66/232 |

*Primary Examiner*—Ronald Feldbaum

*Attorney, Agent, or Firm*—Robert E. Burns; Emmanuel J. Lobato; Bruce L. Adams

[57] ABSTRACT

A cam-support carriage for a knitting machine comprises movable cams for controlling knitting needles. The cams are adapted to be put out of operation by an electro-magnetic positioning device. The electro-magnetic device comprises a permanent magnet having a low coercive field associated with a magnetization/demagnetization coil and a moving part of ferromagnetic metal, integral with the cam to be positioned. The coil is connected to an excitation and control circuit ensuring magnetization and demagnetization of the permanent magnet by a current pulse in the coil, in order respectively to attract and release said moving part and its integral cam in order to being the cam out of or into operation.

5 Claims, 3 Drawing Figures

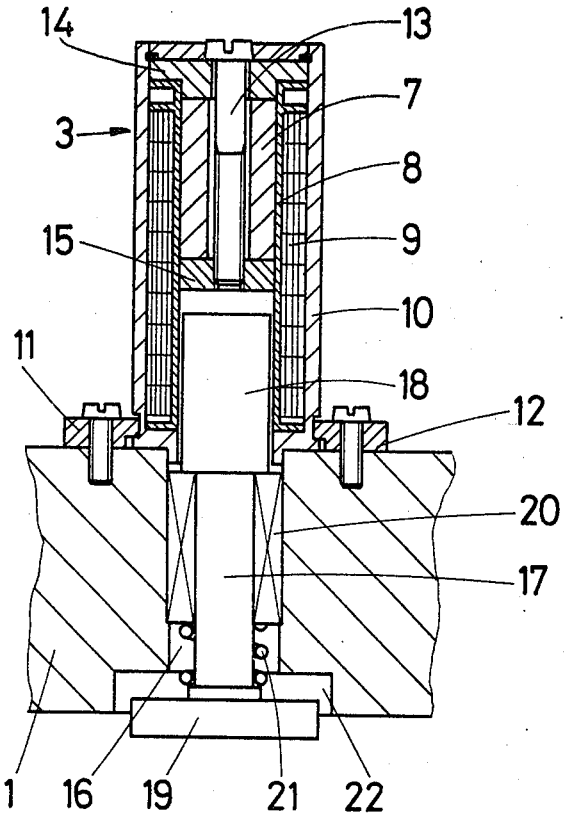
Fig. 2
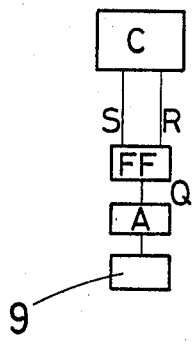
Fig. 3
Fig. 1
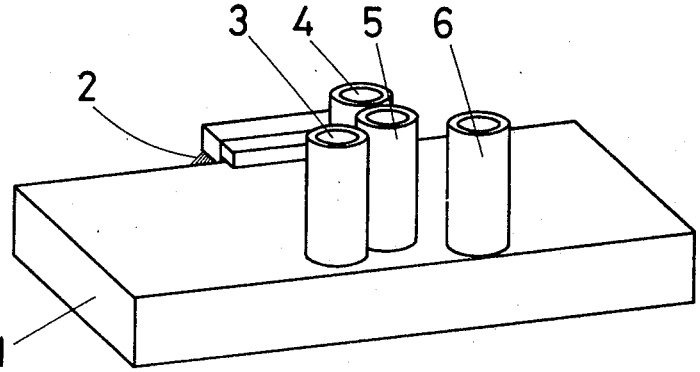

CAM-SUPPORT CARRIAGE FOR A KNITTING MACHINE

BACKGROUND OF THE INVENTION

This invention relates to knitting machines.

In modern knitting machines, cam-support carriages are equipped with knitting cams able to occupy two positions, one being an active position and the other an inactive position. In certain known knitting machines, as described in Swiss Patent No. 539 157, the programme for actuating the cams of the carriage to move the carriage from one end of the needle row to the other is recorded in a first memory and in another memory, separate from the first, there is recorded the programme for movements in the opposite direction. The information memorized is transmitted to the cams of the carriage by means of a reading device and a mechanical control device. The transmission is effected by sliding rods integral with the carriage and cooperating with stops. If the stops are stationary, at the ends of the machine, the carriage must move from one end of the machine to the other, even if only part of the width of the machine is used for knitting, and this constitutes a loss of time. In order to prevent this, the stops must be capable of being moved along the needle rows but this requires a relatively heavy and complicated mechanism.

It has been proposed to replace this mechanical control by electro-magnets mounted on the cam-support carriage. However, the latter must be relatively heavy and powerful, which makes the carriage considerably heavier and thus makes its movement difficult.

In order to obviate this drawback, it has been proposed in German Patent Application No. 1 435 161 to combine a mechanical control comprising a lever with an electro-magnetic control, this combination makes it possible to use retaining electro-magnets of low power.

SUMMARY OF THE INVENTION

The object of the present invention is to eliminate the mechanical part of the control by using electro-magnetic positioning means operating both as a memory and as actuating means, these electro-magnetic means consuming only a very small current.

According to the present invention there is provided a cam-support carriage for a knitting machine, comprising movable cams for controlling knitting needles and adapted to be put out of operation by an electro-magnetic positioning device, which comprises a permanent magnet having a low coercive field associated with a magnetization/demagnetization coil, and a moving part of ferro-magnetic metal, integral with the cam to be positioned, the coil being connected to an excitation and control circuit ensuring magnetization and demagnetization of the permanent magnet by a current pulse in the coil, in order respectively to attract and release said moving part and its integral cam in order to bring the cam out of or into operation.

This solution makes it possible to eliminate all rods and the control linkage and to dispense with stops. It is subsequently possible to vary the travel of the carriage in order to adapt the latter to the effective width of the knitting machine, this travel is controllable by electronic means which, for example, count the needles.

The use of demagnetizable, i.e. bistable permanent, magnets makes it possible to operate with short current pulses, these pulses are memorized by the bistable permanent magnets.

BRIEF DESCRIPTION OF THE DRAWINGS

The accompanying drawings illustrate one embodiment of the invention, by way of example. In the drawings:

FIG. 1 is a diagrammatic perspective view of a cam-support.

FIG. 2 is an axial sectional view of one of the devices for positioning the knitting cams.

FIG. 3 is a block diagram of the control circuit of a positioning device.

DESCRIPTION OF THE PREFERRED EMBODIMENT

FIG. 1 shows diagrammatically a cam-support 1 with its brush 2 and four control devices 3, 4, 5 and 6, respectively associated with four knitting cams arranged, in known manner, below the plate 1, these cams are either retracted into the plate 1, in the inoperative position, or project below this plate, in the operative position, in order to entrain the needles by their heel, in a manner known per se. The present invention is not concerned with means for controlling drop cams and consequently the latter have not been shown. These means will prferably the electro-mechanical, for example a stepping motor.

Each of the control devices 3 to 6 is constructed as illustrated in FIG. 2. Each control device essentially comprises a permanent magnet 7 having a low coercive field, and the magnet is of tubular, cylindrical shape and mounted in a tubular carcase 8 supporting a cylindrical coil 9, the length of which is approximately twice the length of the permanent magnet 7. The carcase 8 is mounted in a tubular support 10 fixed to the cam-support 1 by means of catches 11 and 12. The permanent magnet 7 is retained axially by means of a non-magnetic screw 13 of, for example, stainless steel between a plate 14 of ferro-magnetic material like the tubular support 10 and a plate 15 of soft steel. The tubular support 10 is mounted above a passage 16 extending through the cam-support 1 and through which passes a rod 17 connecting a plunger core 18 of ferro-magnetic metal and a knitting cam 19. In order to be able to move axially very freely, the rod 17 is mounted on an axial bearing bushing 20 constituted by balls. Mounted between the bushing 20 and the cam 19 is a return spring 21 which is subject to compression and tends to keep the cam 19 in the working position as illustrated in the drawing. This spring 21 is very stiff and in practice it is not compressed when the cam 19 is in the operating position. Its force increases rapidly at the time of attraction of the core 18 and reaches approximately 1 kg.

In the position illustrated in FIG. 2, the permanent magnet 7 is demagnetized. This magnet may be magnetized by a current pulse of appropriate direction in the coil 9. The effect of this is to move the plunger core 18 in the direction of the permanent magnet 7 thus compressing the spring 21. The plunger core 18 bears against the soft iron plate 15 which serves as a damper therefor. The cam 19 is retracted into its housing 22 and it is henceforth inoperative. In order to return the cam 19 into a working position, it is sufficient to demagnetize the permanent magnet 7 by a current pulse in the opposite direction in the coil 9 to create for a brief instant a magnetic field greater than the coercive field of the permanent magnet. The cam 19 is restored instantaneously to the working position by the expansion of the spring 21, which is very stiff.

The transmission of two or more successive demagnetization pulses could cause inverse magnetization of the permanent magnet, which would consequently have the result of putting the cam out of operation, when it is the precise wish to place the latter in the operative position. In order to prevent an incident of this nature, the control circuit, shown diagrammatically in FIG. 3, comprises a safety device constituted essentially by a bistable circuit FF. The magnetization pulses are applied to the terminal S and the demagnetization pulses to the terminal R. They emanate from a control circuit C comprising either a manual control with keys or an automatic programmed control. When the permanent magnet 7 is magnetized, a demagnetization pulse on the terminal R causes tripping of the bistable circuit FF. On the other hand, a second demagnetization pulse has no effect as long as the bistable circuit FF has not been retripped under the influence of a magnetization pulse. The change of state at the output Q is used in manner known per se in order to hold a control pulse from a power circuit A which supplies a short and high current pulse, in one direction or the other, in the coil 9. Since the pulses are very short, their power may be high, which makes it possible to obtain a very short tripping time, of the order of 7 ms for the cam. This makes it possible to work very quickly with virtually instantaneous knitting changes.

Naturally, the invention is not limited to the embodiment described, but extends to any variation within the scope of the accompanying claims, in particular to any other shape and arrangement of the permanent magnet, of the coil and of the moving part of ferro-magnetic metal constituting the plunger core. It is also possible to provide a lever between the moving part of ferro-magnetic metal and the cam.

What is claimed is:

1. A cam-support carriage for a knitting machine comprising, a plurality of control devices for each controlling an individual respective knitting cam, and each having a knitting cam, each controlling device comprising means for controlling actuation of said knitting cam to a projected working position and for controlling actuation of said knitting cam to a retracted, non-working position, said means comprising permanently magnetized magnetizable means having a coercive field and energizable means receptive of control current pulses of opposite polarities to change the magnetization and coercive force of the coercive field of said magnetizable means for selectively alternately rendering the magnetizable means effective to control actuation of the knitting cam to said working position from said retracted non-working position and for rendering the magnetizable means selectively effective to control actuation of said knitting cam back to said retracted, non-working position as a function of the change of coercive force of the magnetic coercive field continuously generated by said magnetizable means.

2. A cam-support carriage for a knitting machine according to claim 1, in which said magnetizable means is a permanent magnet, and in which said energizable means comprises a coil for receiving said control pulses of opposite polarities alternately effective to reduce the force of the coercive field of said permanent magnet to effect control of said cam to said retracted, non-working position.

3. A cam-support carriage for a knitting machine according to claim 1, including a return spring comprised constantly biasing said knitting cam to said working position when said knitting cam is in said retracted non-working position.

4. A cam-support carriage for a knitting machine according to claim 3, in which said return spring is very stiff so that the biasing force it develops increases rapidly as it is compressed upon retraction of said knitting cam to said retracted, non-working position.

5. A cam-support carriage for a knitting machine according to claim 1, in which said control device comprises movable means connected to said knitting cam attracted by said magnetizable means when said energizable means is energized to effect the retraction of the knitting cam to said retracted, non-working position, and means to apply said control pulses in opposite polarities, and a safety device comprising a bistable circuit changing in state upon application of control pulses connected to insure only pulses of opposite polarity are applied alternately to said control device.

* * * * *